United States Patent [19]

Sundberg

[11] Patent Number: 4,821,625

[45] Date of Patent: Apr. 18, 1989

[54] VALVE DEVICE FOR CONTROLLING THE DELIVERY OF PRESSURIZED LIQUID TO TWO SEPARATE HYDROSTATIC MOTORS

[76] Inventor: Jonas Sundberg, Fruängsgatan 49, S-126 65 Hägersten, Sweden

[21] Appl. No.: 145,748

[22] Filed: Jan. 19, 1988

Related U.S. Application Data

[63] Continuation of Ser. No. 15,505, Feb. 9, 1987, abandoned, which is a continuation of Ser. No. 688,887, Jan. 4, 1985, abandoned.

[51] Int. Cl.[4] ..... F15B 13/06

[52] U.S. Cl. ..... 91/516; 91/517; 91/532; 137/118; 137/500

[58] Field of Search ..... 137/118, 498, 501, 504, 137/505.13, 882, 500; 91/516, 517, 532

[56] References Cited

U.S. PATENT DOCUMENTS

| | | | |
|---|---|---|---|
| 3,099,284 | 7/1963 | Thrap et al. | 137/118 |
| 3,223,115 | 12/1965 | Kates | 137/501 |
| 3,323,533 | 6/1967 | Reimer | 137/118 |
| 3,464,439 | 9/1969 | Budzich | 137/504 |
| 3,842,859 | 10/1974 | Reinke | 137/882 |
| 4,016,895 | 4/1977 | Budecker | 137/118 X |
| 4,084,604 | 4/1978 | Budecker et al. | 137/118 X |
| 4,139,988 | 2/1979 | Adachi | 91/532 X |
| 4,422,470 | 12/1983 | Jackson et al. | 137/501 X |

FOREIGN PATENT DOCUMENTS

| | | |
|---|---|---|
| 906583 | 1/1946 | France . |
| 867459 | 6/1952 | France . |

*Primary Examiner*—Stephen Hepperle

*Attorney, Agent, or Firm*—Hill, Van Santen, Steadman & Simpson

[57] ABSTRACT

Valve device for controlling the delivery of pressurized fluid from a common pump to two hydrostatic working motors, one of which is subjected to a load dependent on the speed of the other motor. A volume flow regulator is disposed in the flow path between an inlet port of the valve device connected to the pump and an outlet port connected to the other working motor and varies the volume flow rate in this flow path in inverse proportion to the pressure in the inlet port to keep that pressure substantially constant.

5 Claims, 2 Drawing Sheets

VALVE DEVICE FOR CONTROLLING THE DELIVERY OF PRESSURIZED LIQUID TO TWO SEPARATE HYDROSTATIC MOTORS

This is a continuation, of application Ser. No. 15,505, filed Feb. 9, 1987 now abandoned. which is a continuation of application Ser. No. 688,887, filed Jan. 4, 1985 now abandoned.

BACKGROUND OF THE INVENTION

1. Field of the invention:

The invention relates to a valve device for controlling the delivery of pressurized liquid to two separate hydrostatic motors from a common source of pressurized liquid which is variable in respect of pressure.

2. Prior Art:

In certain kinds of working machines, for example, two or more simultaneously operating hydrostatic working motors are supplied from a common pump, the load on one of the motors varying in dependence on a working parameter, such as the speed, of another working motor. A concrete sawing machine of the type used for cutting openings in concrete walls and the like may be taken as an example of such a working machine.

A known embodiment of such sawing machines has a main drive motor in the form of a hydrostatic rotary motor mounted on a movable carriage and driving a diamond saw blade. Moreover, the sawing machine has a feed motor which is also mounted on the carriage and takes the form of a rotary motor, preferably reversible, serving to displace the carriage in either direction on guides secured to the wall or the like to be cut. An additional feed motor may also be provided which serves to displace the saw blade transversely of the plane in which the carriage is moved.

As is readily appreciated, the rate of feed, that is, the speed of the carriage, has to be matched with the nature of the material to be cut, the properties of the saw blade, and so on. In the known sawing machines, however, this requirement cannot be met reliably with reasonably simple means. This is so at least in the frequent instances where the sawing properties vary from one sawing operation to the next or in the course of one and the same sawing operation. For example, when cutting lightweight concrete, the rate of feed may of course be much higher than when cutting ordinary concrete. In the latter instance, the sawing properties may vary in the course of the sawing operation, e.g. at the locations where steel reinforcement bars have to be cut. The problem is aggravated because the force required to displace the carriage (disregarding the cutting force) may vary for various reasons, e.g. because the guides are misaligned or because the power transmission becomes dirty with concrete dust and jams.

SUMMARY OF THE INVENTION

An object of the invention is to provide a valve device of the above-indicated kind controlling the delivery of pressurized liquid to the motors such that the load on one motor, the main drive motor in the examplary case, is kept substantially constant and at a selected level by automatic control of the volumetric flow rate of the supply to the other motor, the feed motor in the exemplary case.

The foregoing object is achieved in the valve device of the invention. As explained in greater detail hereinafter, the valve device includes in the flow path between the pump and the other motor, the feed motor, a volume flow rate regulator controlled in response to the pressure existing in the flow path between the pump and the first motor to reduce the volume flow rate of the supply to the other motor as the just-mentioned pressure tends to increase.

Other objects, features and advantages of the invention will be evident from the following description of embodiments with reference to the accompanying drawings.

DETAILED DESCRIPTION

The working machine is assumed to be a sawing machine of the kind discussed above, although the applicability of the invention is not limited to machines of that kind.

Figure 1:
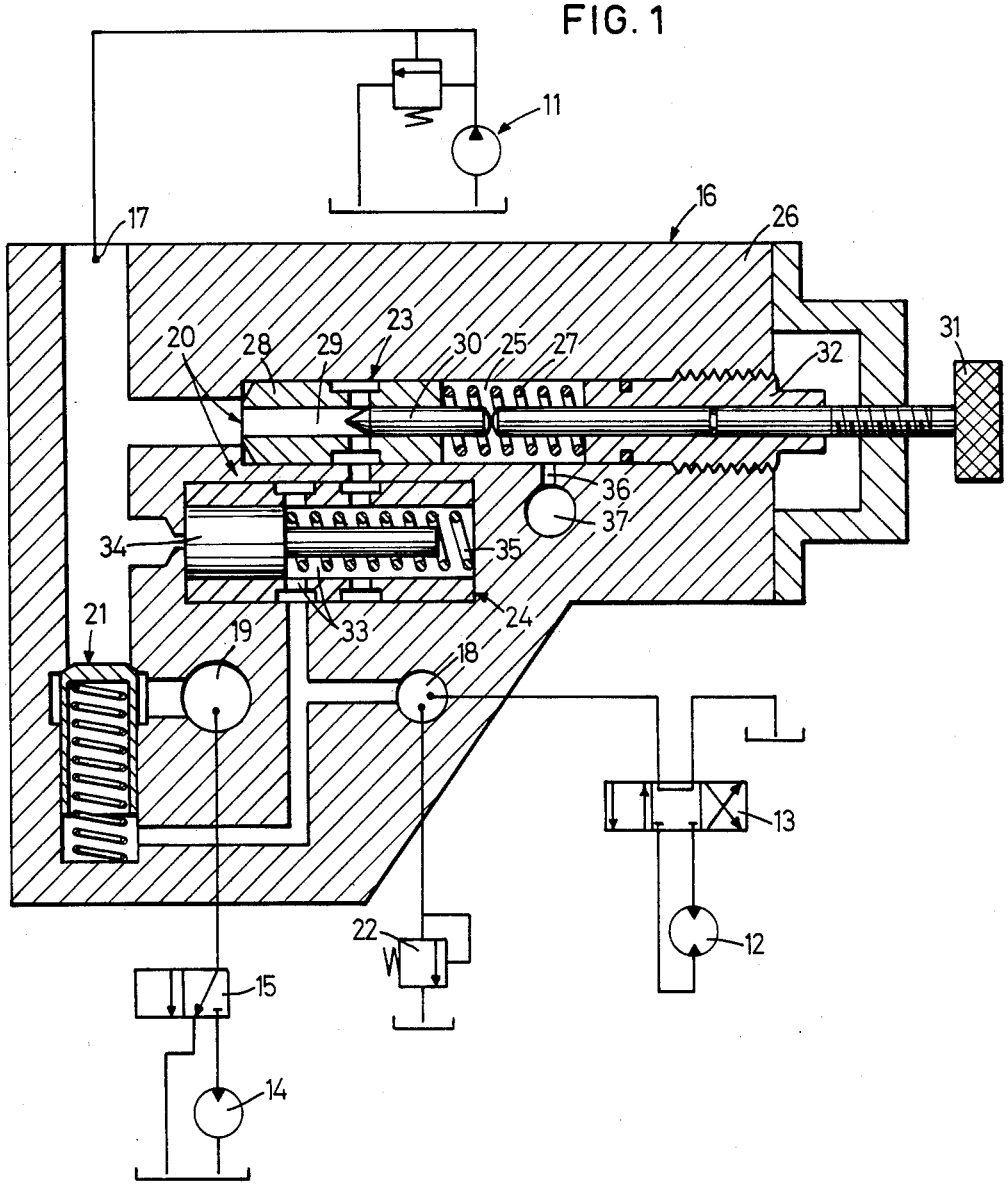
FIG. 1 diagrammatically illustrates, partly in cross-section, an embodiment of a hydraulic system including a valve device according to the invention.

The system illustrated in FIG. 1 includes a source of pressurized liquid in the form of a hydrostatic pump 11 with an associated relief or pressure-limiting valve, a reversible first hydrostatic working motor 12 with an associated control valve 13, a second hydrostatic working motor 14 with an associated control valve 15, and a control valve device 16 embodying the invention which is connected between the pump 11 on the one hand and the control valves 13 and 15 on the other hand.

Of the two working motors, both of which are rotary motors, motor 12 is a feed motor serving to displace a carriage of the sawing machine in either direction on guides, while motor 14 is a main drive motor supported by the carriage and serving to drive a diamond saw blade. All components except the control valve device 16 are assumed to be of a kind known per se and need not, therefore, be described in greater detail.

Control valve device 16 has an inlet port 17 connected to pump 11, a first outlet port 18, to which feed motor 12 is connected through its control valve 13, and a second outlet port 19, to which main drive motor 14 is connected through its control valve 15.

The flow path between inlet port 17 and feed motor port 18 includes a volume flow regulator 20 which is controlled in response to the pressure existing in inlet port 17 such that it reduces the volume flow rate of the supply to the feed motor when the pressure in inlet port 17 exceeds a preset level. The flow path between inlet port 17 and main drive motor port 19 includes a pressure-controlled check valve 21 which is opened when the pressure differential between inlet port 17 and feed motor port 18 exceeds a given, relatively low level.

Connected with feed motor port 18 is also a safety or pressure-limiting valve 22 ensuring that the pressure existing in the feed motor port does not exceed a given value, e.g. 60 bar.

Volume flow regulator 20 serves to control the volume flow rate of the supply to feed motor 12 and, accordingly, the speed of that motor such that the pressure in inlet port 17 is maintained at or near a predetermined level during the sawing operation. It comprises a first pressure-controlled restrictor valve 23 and a second pressure-controlled restrictor valve 24 connected in series with the first restrictor valve. Valve 23 is controlled by the pressure in inlet port 17, and valve 24 is controlled by the pressure differential across valve 23.

The first restrictor valve 23 is accommodated in a passage 25 provided in a housing 26 of valve device 16 and having an open connection with inlet port 17. It comprises an axially displaceable valve sleeve 28 loaded by a spring 27 and having a flow passage 29 extending therethrough, and a needle valve rod 30 which extends into passage 29 and is adjustable to different positions in housing 26 by means of a knob 31. Valve sleeve 28 is constantly acted on by the pressure in inlet port 17 which acts in the direction opposite to the direction of the force of spring 27.

As long as the pressure in the inlet port is below a level determined by spring 27 and adjustable by screwing a support plug 32 for the spring outwardly or inwardly in housing 26, valve sleeve 28 is in the illustrated position in which it abuts a shoulder in housing 26. Flow passage 29 then has its maximum cross-sectional flow area as determined by the setting of knob 31.

The inlet of the second restrictor valve 24 is connected to the outlet of the first restrictor valve, and its outlet is connected to feed motor port 18. The cross-sectional flow area of a flow path 33 through restrictor valve 24 is controlled by a plunger 34 one end of which is constantly acted on by the pressure in inlet port 17 by way of a damping orifice and the other end of which is acted on by a spring 35 and the pressure existing at the inlet of restrictor valve 24, that is, the pressure on the downstream side of the first restrictor valve 23. The function of the second restrictor valve 24 is to keep the pressure drop across the first restrictor valve 23 constant, that is, independent of the pressure in inlet port 17.

The end of valve sleeve 28 remote from inlet port 17 forms a movable wall of a liquid-filled compartment accommodating spring 27 and connected through a damping orifice 36 with a liquid-filled chamber 37 which is at substantially zero pressure. The liquid in the compartment serves to damping the motions of the valve sleeve.

The operation of control valve device 16 will become clear from the following description of a sawing operation. All numerical values given in connection with this description should only be taken as illustrative examples of actual values and are not intended to be construed as limitations.

When the hydraulic system is idling, that is, when neither feed motor 12 or main drive motor 14 are driven, both feed motor port 18 and main drive motor port 19 are connected to the tank, that is, they are nearly at zero pressure. The pump then delivers liquid at a volume flow rate of 40 l/min and relatively low pressure, 15 bar.

Volume flow regulator 20 limits the volume flow rate of the supply to feed motor port 18 to 5 l/min. The remaining portion of the total supply, that is, 35 l/min, flows through check valve 21 to main drive motor port 19. Of the total pressure drop between inlet port 17 and the tank, a pressure drop of 5 bar exists across the first restrictor valve 23, and a pressure drop of 9 bar exists across the second restrictor valve 24. A pressure of 1 bar (resulting from the resistance of the conduit to the tank) thus exists in feed motor port 18. The pressure drop across check valve 21 accordingly is 14 bar, which is sufficient to keep check valve 21 open.

The sawing operation is commenced by displacing the carriage which supports main drive motor 14 with the saw blade to the position where the cutting is to begin. To this end, control valve 13 is actuated to connect one side of feed motor 12 with feed motor port 18 and to connect the other side with the tank. Because the saw blade is not yet in engagement with the material to be cut, the carriage can be displaced relatively easily, and for that reason motor 12 only requires a pressure of 20 bar.

The pump will now deliver its supply of 40 l/min at a pressure which is 20 bar above the idling pressure, that is, at 35 bar. The pressure drops across restrictor valves 23 and 24 remain unchanged, and the flow rate of the supply to feed motor port 18 also remains unchanged. If feed motor 12 encounters an increased or reduced resistance during the displacement of the carriage, the difference in pressure between the inlet port 17 and the backside of the valve 21 is changed correspondingly, that is the pressure drop from the inlet port 17 to the main motor port 19, whereas the pressure drops across the modes 23 and 24 remain unchanged (it is assumed here that the opening or cracking pressure of valve 22 is not exceeded.)

When the carriage has reached the proper position, feed motor 12 is stopped whereupon control valve 15 of main drive motor 14 is opened. Motor 14 accordingly starts rotating, but initially only causes a pressure drop of 10 bar, because the saw blade is not yet engaging the workpiece. The pressure in inlet port 17, as well as the pressure drops across the valves 23 and 24 remain unchanged, whereas the pressure drop across valve 21 is reduced to 4 bar.

The saw blade is then brought into engagement with the workpiece by displacing it towards the workpiece by means of a separate feed motor (not shown) connected to feed motor port 18 in the same manner as feed motor 12. Feed motor 12 is then started again.

As feed motor 12 displaces the carriage with the saw blade in engagement with the workpiece, it initially tends to effect the displacement at the same speed as during the above-described positioning displacement of the carriage. However, in the case of cutting concrete or some other fairly hard material, cutting at this speed will cause overloading of the saw blade and the main drive motor. As a result, there is a rapid increase of the pressure drop across main drive motor 14 and, accordingly, the pressure in the inlet port 17. When the pressure in inlet port 17 reaches the value set by means of the plug 32–175 bar—valve sleeve 28 is displaced to reduce the cross-sectional flow area of restrictor valve 23. The pressure drop across the latter still is constant, and hence the volume flow rate of the supply to feed motor 12 is reduced in dependence on the reduction of the cross-sectional flow area so that the speed of the feed motor is also reduced.

The reduction continues until the speed of feed motor 12 has reached the value corresponding to the preselected load of the main drive motor, that is, the preset inlet pressure of 175 bar. Normally, the pressure in feed motor port 18 is much lower than the preset inlet pressure and consequently check valve 21 is fully open during the sawing operation. Inlet port 17 therefore has a zero, or at least substantially zero, pressure drop connection with main drive motor 14.

From the foregoing description it is clear that even if the hardness of the cut material, the cutting depth or some other parameter varies in the course of the sawing operation, volume flow regulator 20 will ensure that the rate of feed is varied such that the saw blade and the main drive motor operate under a substantially constant load.

Figure 2:
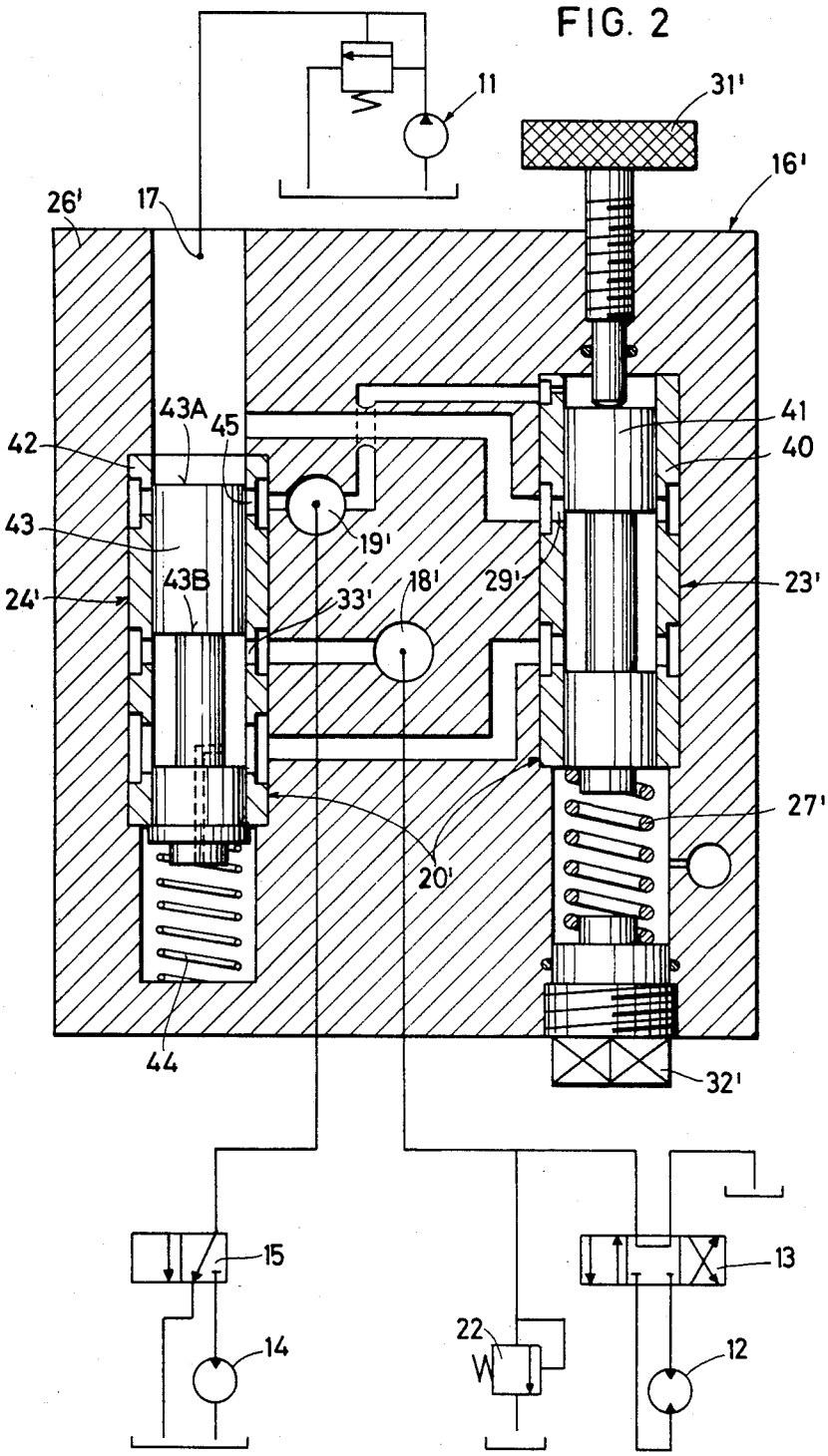
FIG. 2 is a view similar to FIG. 1 of a modification of the system of FIG. 1 and represents the presently preferred embodiment.

The hydraulic system shown in FIG. 2 differs from the system of FIG. 1 in respect of the control valve device. In FIG. 2 the same reference numerals as in FIG. 1 are used for like or corresponding elements with addition of a prime sign for the elements of the control valve device.

Volume flow rate regulator 20' likewise serves to control the volume flow rate of the supply to feed motor 12 and, consequently, the speed of that motor such that the pressure in outlet port 19' is kept at or near a certain given level during the sawing operation. As in the above-described embodiment it comprises a first pressure-controlled restrictor valve 23' and a second pressure-controlled restrictor valve 24' connected therewith.

The first restrictor valve 23' comprises a valve sleeve 40 in valve housing 26' and a spool 41 which is axially displaceable in the valve sleeve and biased in one direction by a compression spring 27'. By means of a knob 31', the spool is displaceable against the action of compression spring 27', and the spring bias may be varied by means of a threaded plug 32'. At the side of spool 41 remote from compression spring 27' there is a chamber which is connected with main drive motor port 19'. A flow passage 29' provided in valve sleeve 40 and controlled by valve spool 41 is in constant open communication with inlet port 17. Flow passage 29' communicates by way of a further passage in valve sleeve 40 and a passageway in housing 26' with a flow passage in valve 24' leading to feed motor port 18'.

As long as the pressure in main drive motor port 19' is below a level determined by spring 27', valve spool 41 is in the illustrated position in which it abuts knob 31'. Flow passage 29' then has its maximum cross-sectional flow area as determined by the setting of knob 31'.

The second restrictor valve 24' also comprises a valve sleeve 42 in valve housing 26' and a valve spool 43 which is axially displaceable in the valve sleeve. A relatively weak spring 44 urges valve spool 43 toward the illustrated position in engagement with an abutment. One end 43A of valve spool 43 is constantly acted on by the pressure in inlet port 17, and the opposite end is acted on by spring 44 and the pressure existing in the connecting passageway between valve 23' and valve 24' As in the first embodiment, valve 24' serves to keep the pressure drop across the first valve 23' constant.

The operation of control valve device 16' will become clear from the following description of a sawing operation. As in the previous description, the numerical values are only given as illustrative examples.

When the hydraulic system of FIG. 2 is idling, pump 11 delivers liquid at a volume flow rate of 40 l/min and at a pressure of 15 bar.

Volume flow regulator 20' limits the volume flow rate of the supply to feed motor port 18' to 5 l/min. The remainder of the total supply, 35 l/min, flows to main drive motor port 19' through a passage 45 controlled by the upper face 43A of spool 13. The pressure drop across flow passage 29' in valve 23' is 14 bar, and consequently a pressure of 1 bar exists in feed motor port 18'. 45, and consequently a pressure of 1 bar exists in main drive motor port 19'.

When the sawing operation is commenced by connecting feed motor 12 with feed motor port 18', the pressure in port 18' increases to 21 bar. The pressure drop across flow passage 29' in valve 23' still is 14 bar and the pressure in inlet port 17 consequently is 35 bar. In this position, the upper face 43A of valve spool 43 of valve 24' is effective to keep the pressure in main drive motor port 19' at bar so that a pressure drop of 34 bar is developed across flow passage 45. Upper face 43A of valve spool 43 is constantly effective to develop a greater or smaller pressure drop across flow passage 45 as long as the pressure in feed motor port 18' exceeds the pressure in main drive motor port 19' On the other hand, as the pressure in main drive motor port 19' exceeds the pressure in feed motor port 18', valve spool 43 moves to a downwardly displaced position so that its lower face 43B coacts with a flow a pressure drop of 14 bar is developed across flow passage 33' in valve sleeve 42 to keep the pressure drop across the flow passage 29' constant. Otherwise, valve device 16' operates in substantially the same manner as the above-described valve device 16.

What I claim is:

1. A valve device for controlling the delivery of pressurized liquid to two separate hydrostatic motors from a common source of pressurized liquid which is variable in respect of pressure, comprising: an inlet port for connection to the source of pressurized liquid, two outlet ports for connection to respective ones of the motors, means defining flow paths between said inlet port and each of said outlet ports, and control valve means in said flow paths, said control valve means in said flow path between said inlet port and one of said motor connection ports including a volume flow regulator controlled by pressure to change volume flow rate in inverse proportion to the controlling pressure and having a control input which has a substantially zero pressure drop connection with the other of said motor connection ports, said volume flow regulator being biased by a spring balancing the pressure-control force up to a predetermined control pressure, said volume flow regulator comprising a first restrictor valve connected to said inlet port and controlled by the pressure therein, and a second restrictor valve connected to an outlet of said first restrictor valve and controlled by the pressure differential across said first restrictor valve, said first restrictor valve including a mechanically positionable first valve element and a second valve element displaceable relative to said first valve element by the control pressure against the action of a spring force.

2. A valve device according to claim 1, in which said first valve element is a valve needle and said second valve element is an axially movable valve sleeve into which said first valve element extends.

3. A valve device according to claim 2, including a valve provided in said flow path between said inlet port and said other motor connection port which valve is normally closed but adapted to be opened in response to a predetermined pressure differential between said inlet port and said one motor connection port.

4. A valve device for controlling the delivery of pressurized liquid to first and second hydrostatic motors from a common source which is variable in respect to the pressure of the delivered pressurized liquid, the first motor being subject to a load that is dependent on the speed of the second motor, comprising:

an inlet port to connect said valve device to said common source;

first and second outlet ports to connect said valve device to said respective first and second motors;

means defining a first flow path between said inlet port and said first outlet port and defining a second flow path between said inlet port and said second outlet port;

a pressure-controlled rate regulator in said second flow path having a control port connected to said inlet port and being operable by pressure in said inlet port, said rate regulator including:

a displaceable flow metering member subjected to pressure in said inlet port;

an abutment defining a maximum flow rate position of said flow metering member;

a spring biasing said flow metering member toward said abutment, said flow metering member being displaceable against the bias from the maximum flow rate position to reduce the flow rate in the second flow path, said spring balancing the pressure in the inlet port up to a predetermined pressure level; and a normally closed valve in said first flow path, said valve including a valve member and a spring biasing said valve member toward a closed position, said spring establishing a predetermined relatively lower level so that said valve is operably to a fully open position in response to a pressure differential between said inlet port and said second outlet port exceeding said predetermined relatively lower level to provide a substantially zero drop connection of said inlet port with said first outlet port.

5. Valve device according to claim 4, in which said volume flow regulator comprises a first restrictor valve connected to said inlet port and controlled by the pressure therein, and a second restrictor valve connected to an outlet of said first restrictor valve and controlled by the pressure differential across said first restrictor valve.

* * * * *